United States Patent [19]

Schmid

[11] Patent Number: 5,036,611

[45] Date of Patent: Aug. 6, 1991

[54] WEAPON HOUSING FOR A FIRING WEAPON

[75] Inventor: Samuel Schmid, Fischbach-Goslikon, Switzerland

[73] Assignee: Werkzeugmaschinenfabrik Oerlikon-Bührle AG, Zurich, Switzerland

[21] Appl. No.: 584,109

[22] Filed: Sep. 18, 1990

[30] Foreign Application Priority Data

Oct. 13, 1989 [CH] Switzerland ..... 03741/89

[51] Int. Cl.[5] ..... F41A 3/66

[52] U.S. Cl. ..... 42/39.5; 89/33.03; 42/75.02

[58] Field of Search ..... 42/39.5, 75.02, 75.03, 42/75.01, 54; 89/33.01, 33.03, 199; 124/35.1, 2

[56] References Cited

U.S. PATENT DOCUMENTS

| | | | |
|---|---|---|---|
| 282,553 | 8/1883 | McLean | 89/33.03 |
| 1,486,403 | 3/1924 | Watkins | 124/35.1 |
| 2,221,506 | 11/1940 | Brandon | 124/2 |
| 2,790,353 | 4/1957 | Bird | 42/39.5 |
| 4,548,120 | 9/1990 | Ciekurs | 89/33.03 |

FOREIGN PATENT DOCUMENTS

| | | | |
|---|---|---|---|
| 1219368 | 6/1966 | Fed. Rep. of Germany | 42/54 |

*Primary Examiner*—Michael J. Carone
*Attorney, Agent, or Firm*—Sandler, Greenblum & Bernstein

[57] ABSTRACT

A weapon housing for a firing weapon including a front portion and a rear portion in which the front and rear portions are spaced apart by means of a plurality of bands. The weapon barrel is carried by the front portion and the firing device is carried by the rear portion. Cartridge chambers are fed laterally to the weapon housing. The bands which connect the front and rear portions of the housing, preferably, are fiber bands.

11 Claims, 4 Drawing Sheets

WEAPON HOUSING FOR A FIRING WEAPON

BACKGROUND OF THE INVENTION

1. Field of the Invention

The present invention relates to a weapon housing for a firing weapon which has a weapon barrel secured to the weapon housing, a device for feeding ammunition in cartridge chambers laterally to the weapon, and a device for igniting the cartridges arranged at the rear end of the weapon housing. The ignition device arranged at the rear end of the weapon housing is also referred to as a trigger device or puncture device.

2. Description of Background and Other Information

Already known in the art are firing weapons in which the ammunition is delivered within ammunition chambers laterally of the firing weapon and in which the infed cartridges are fired or ignited by means of an ignition device, such as a cartridge puncture device. In this connection, reference is made to U.S. Pat. No. 3,429,220, issued Feb. 25, 1969, and U.S. Pat. No. 3,890,878, issued Jun. 24, 1975.

Such heretofore known constructions of firing weapons require a relatively large and massive weapon housing, which therefore is correspondingly complicated and expensive to fabricate.

SUMMARY OF THE INVENTION

It is therefore an important object of the present invention to provide an improved construction of a weapon housing which can be fabricated relatively simply and which at least partially consists of plastic material and is light in weight.

For implementing these and still further objects of the invention, which will become more readily apparent as the description proceeds, the weapon housing for a firing weapon, according to the present development, is manifested by the features that, among other things, there is provided a front portion for the reception or carrying of the weapon barrel and a rear portion which contains the ignition device for the cartridges. The front portion and rear portion are arranged in spaced relationship from one another. Means including fiber band members serve for interconnecting both the front portion and rear portion with one another and for maintaining the spacing between such front and rear portions.

More specifically, the present invention is directed to a weapon housing for a firing weapon which includes a front portion; a weapon barrel carried by the front portion; a rear portion arranged in spaced relationship from the front portion; a firing device for cartridges provided for the rear portion; and a plurality of bands for interconnecting the front portion and rear portion with one another and for maintaining the spaced relationship of the front portion and rear portion from one another.

Further, means comprising cartridge chambers are provided for laterally infeeding cartridges to the weapon housing of the firing weapon.

In a preferred embodiment of the invention, each of the bands is comprised of a flexible band or a fiber band member comprised of carbon fibers, preferably imbued with a resin.

Further according to the invention, the front and rear portions comprise plug members and the fiber band members comprise endless fiber band members trained about the plug members of the front and rear portions.

In a further aspect of the invention, the endless fiber band members comprise reinforced endless fiber band members and means are provided for securing the endless reinforced fiber band members to the plug members, which preferably comprises an adhesive connection.

Preferably, each of the endless fiber band members has essentially the same length, the same cross-sectional configuration, and are formed of fibers composed of the same fiber material.

With this construction, the weapon housing is exceedingly light in weight and can be manufactured with a modest amount of manufacturing operation and expense. Furthermore, the endless fiber band members are ideally suited for taking up the forces generated by gas pressure.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which.

DETAILED DESCRIPTION OF PREFERRED EMBODIMENTS

With reference to the drawings, it is to be understood that only enough of the construction of the weapon housing for a firing weapon and related structure has been depicted in order to simplify the illustration and to facilitate the understanding of the underlying principles and concepts of the present invention to those of ordinary skill in the art.

Figure 1:
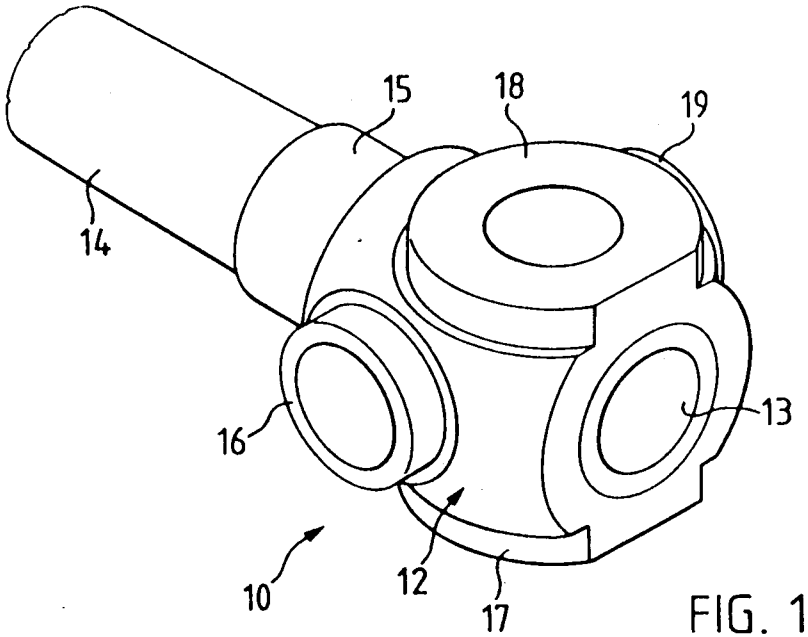
FIG. 1 is a perspective view of the front portion of a weapon housing according to the invention.
Figure 3:
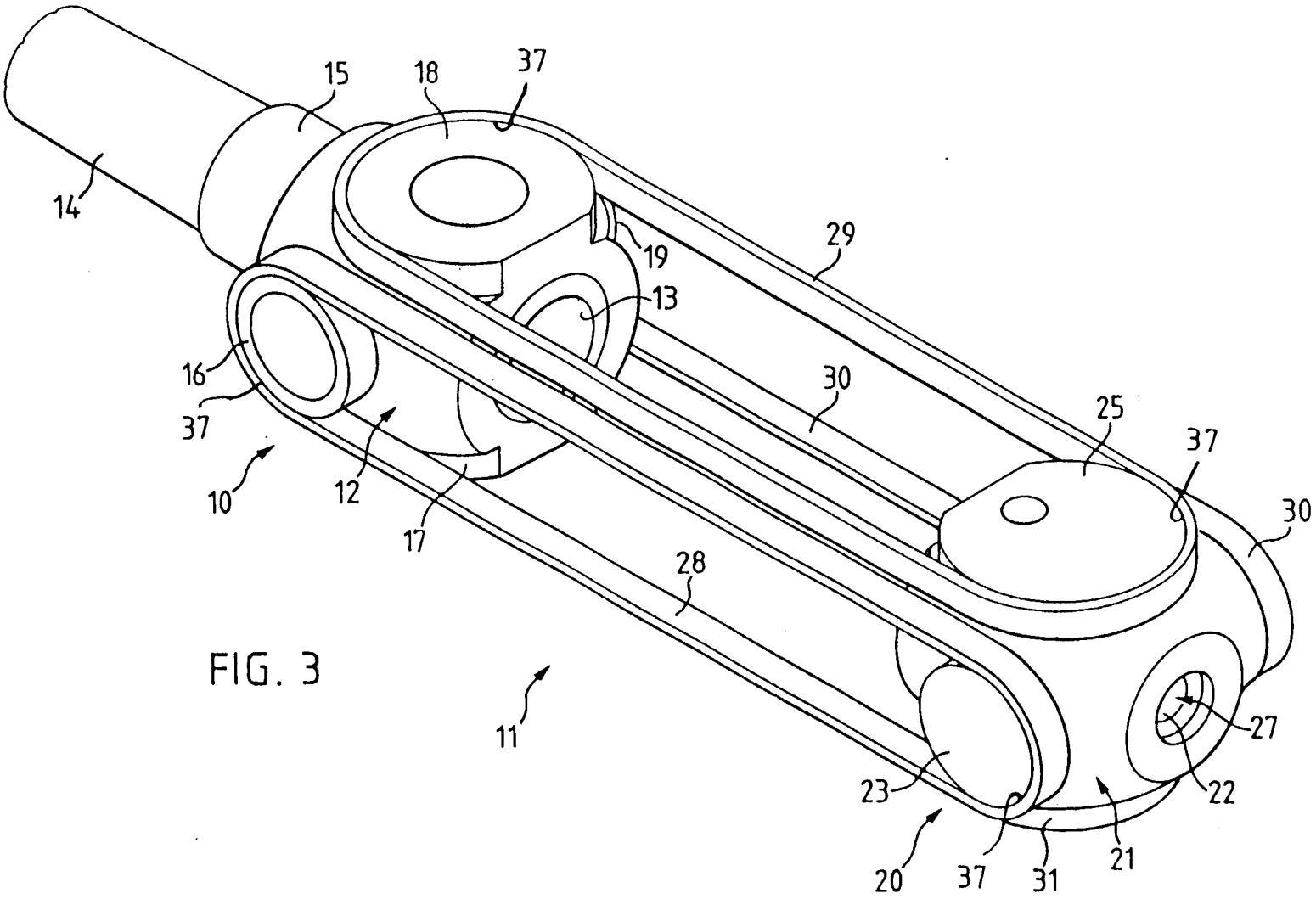
FIG. 3 schematically illustrates, again in perspective view, the weapon housing of the invention, in which the front and rear portions of the housing, shown in FIGS. 1 and 2, respectively, are connected.

With initial reference to FIG. 1, there is depicted the front portion or part 10 of a weapon housing 11, shown more fully in FIG. 3. The front portion 10 comprises a substantially spherical-shaped body or body member 12 having a substantially cylindrical bore 13 which is aligned essentially coaxially with respect to the lengthwise axis of a weapon barrel 14. The weapon barrel 14, only a portion of which has been depicted in the drawings, piercingly extends through a plug or journal member 15 of the front portion 10.

At the substantially spherical-shaped body member 12 there are arranged or formed four additional plug members 16, 17, 18 and 19. In each case, two respective plug members, namely, the plug members 17 and 18, on the one hand, and the plug members 16 and 19, on the other hand, are essentially coaxially arranged with respect to one another. The substantially spherical-shaped body member 12 is preferably formed of one piece together with the five plug members 15, 16, 17, 18 and 19, and, in particular, the front portion 10 of the weapon housing 11 can be very easily cast.

Figure 2:
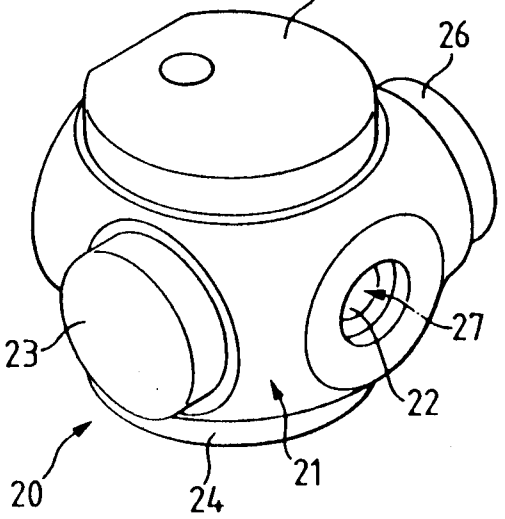
FIG. 2 illustrates the rear portion of the weapon housing, likewise in perspective view.

According to FIG. 2, the rear portion or part 20 of the weapon housing 11 possesses a substantially spherical-shaped body or body member 21. In the assembled state of the weapon housing 11, and as will be seen by referring to FIG. 3, the front portion 10 and the rear portion 20 of the weapon housing 11 are in spaced relationship with respect to one another. The substantially spherical-shaped body member 21 also possesses a substantially cylindrical bore 22 within which there is located a suitable ignition or igniting device, generally indicated by reference character 27. As previously mentioned, the ignition device 27 for the cartridges also is referred to in the art as a cartridge trigger device or cartridge puncture or piercing device. This ignition device 27 is of any suitable known design and therefore need not be here further considered. By way of completeness, it is simply mentioned that the ignition device 27 typically contains a standard firing pin for puncturing the cartridges.

By further reference to FIG. 2, it will be observed that at the substantially spherical-shaped body member 21 there are arranged four plug members 23, 24, 25 and 26 or equivalent structure. In each case, two of these plug members, and specifically, the plug members 23 and 26, on the one hand, and the plug members 24 and 25, on the other hand, are essentially coaxially arranged with respect to one another. Also, the substantially spherical-shaped body member 21 together with the four plug members 23, 24, 25 and 26, are preferably fabricated of one piece or as an integral part which can be easily cast.

In the illustration of FIG. 3, the mutually spaced front portion 10 and rear portion 20 of the weapon housing 11 are interconnected with one another by four endless band or belt members 28, 29, 30 and 31, to thereby form the complete weapon housing 11. These endless band members 28, 29, 30 and 31 comprise fiber band members, preferably formed of carbon fibers and imbued in a suitable resin. These endless fiber bands or band members 28, 29, 30 and 31 are preferably reinforced and are secured to the associated eight plug members 16–19 and 23–26, preferably with the aid of adhesive connections, generally indicated by reference numeral 37, for maintaining the mutual spacing between the front portion 10 and the rear portion 20.

Figure 4:
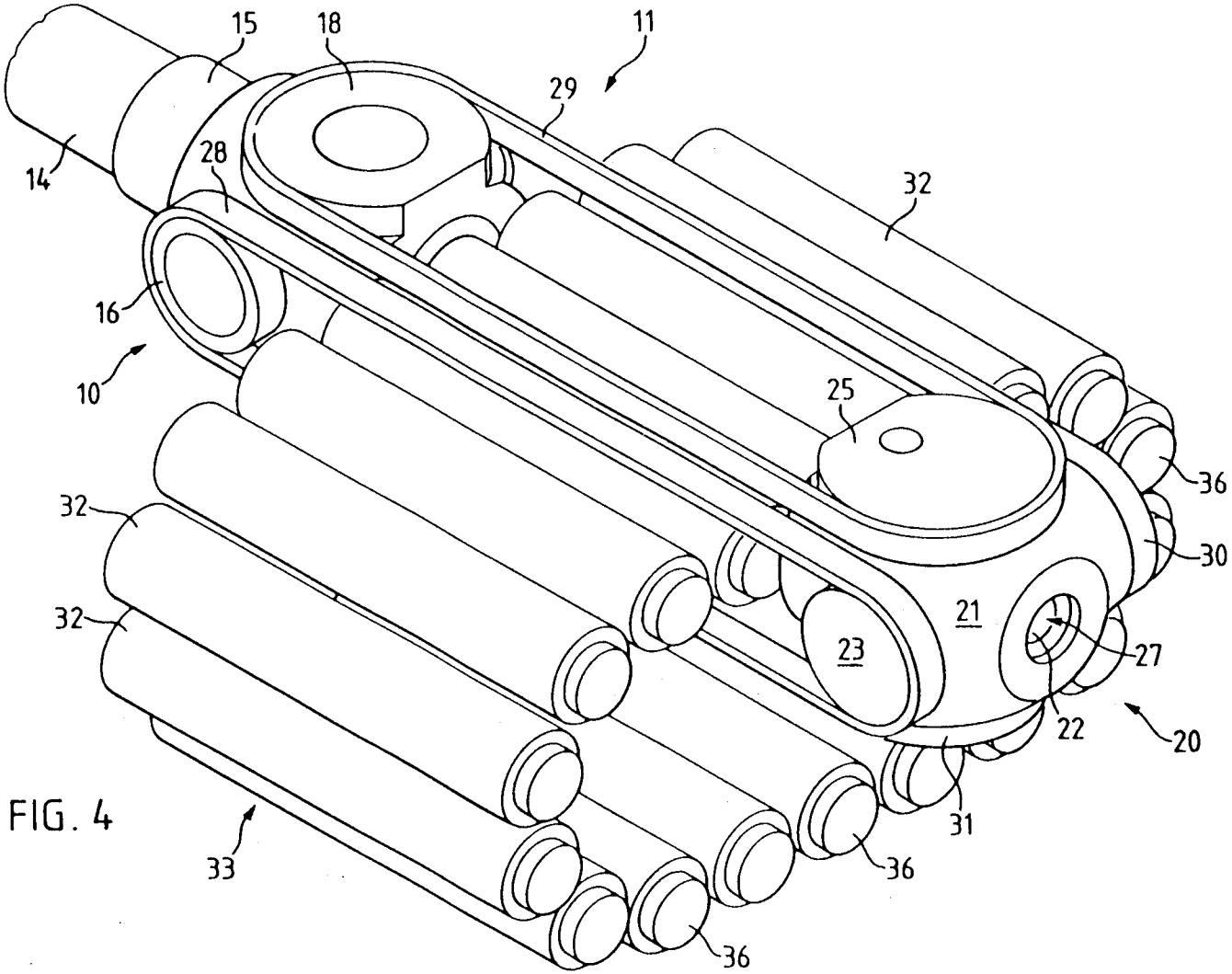
FIG. 4 depicts, in perspective view, the weapon housing illustrated in FIGS. 1–3, together with a device for the infeed of cartridges.

With reference to FIG. 4, it will be recognized that a number of cartridge chambers 32 or the like are interconnected with one another by an endless cartridge band or belt member 33. A cartridge or projectile 36 is located in each cartridge chamber 32. The cartridges or projectile 36 are delivered to the firing weapon by means of the endless cartridge band or belt member 33. A conventional conveyor device, which therefore has not been shown in the drawings, cooperates with the endless cartridge band member 33 for facilitating the advance of the cartridges to a firing position of the firing weapon.

Figure 5:
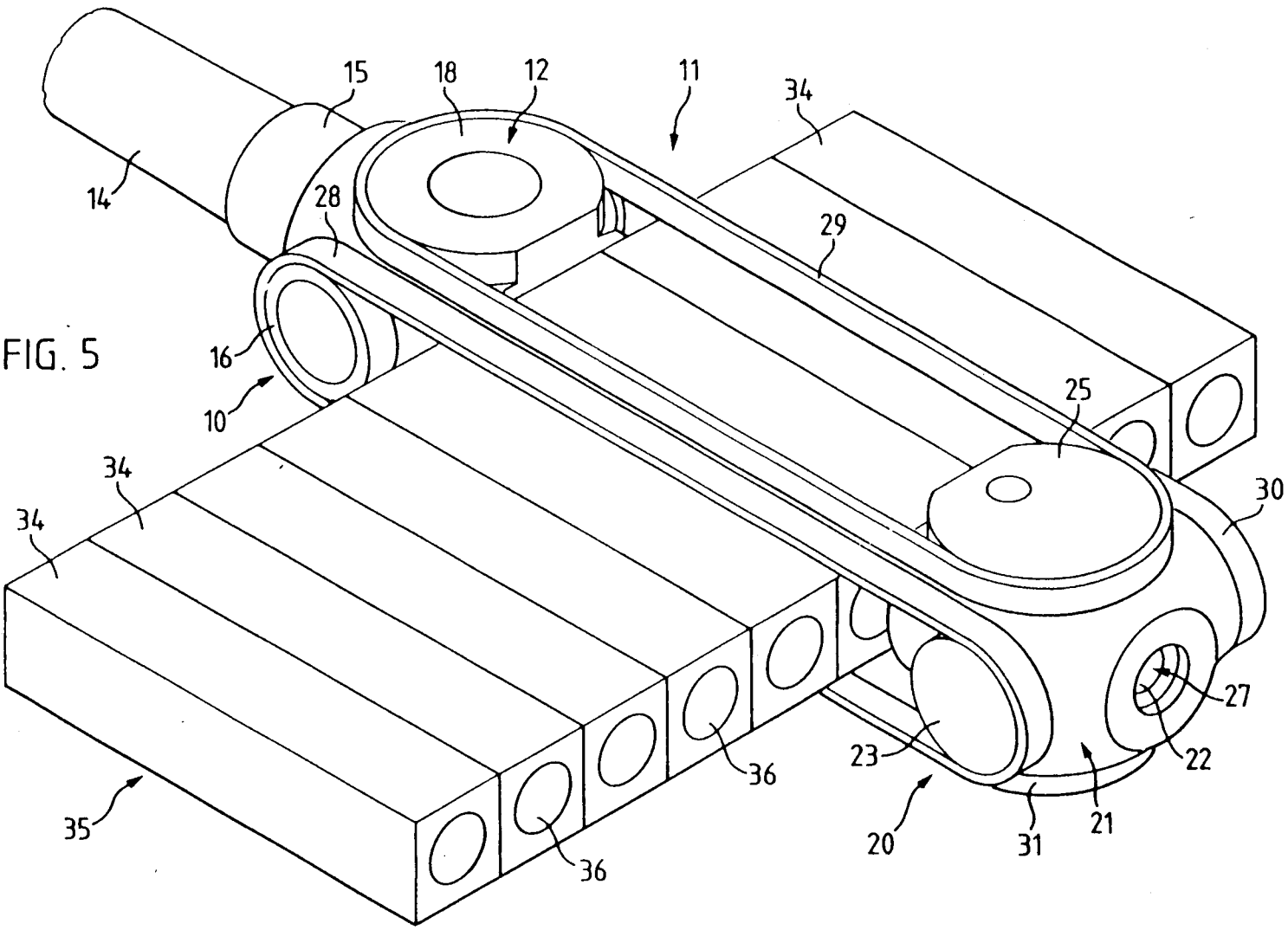
FIG. 5 depicts, again in perspective view, a further construction comprising the weapon housing illustrated in FIGS. 1–3 with a modified design of infeed or feed device for the infeed of cartridges.

In the modified construction of FIG. 5, a number of cartridge chambers 34 are interconnected with one another for forming a rigid cartridge package or cartridge magazine 35. Once again, a cartridge or projectile 36 is located in each cartridge chamber 34. The cartridges or projectile 36 are delivered to the firing weapon by means of the cartridge magazine 35. Here also, the conventional conveyor device for displacing the cartridge magazine 35 has not been depicted to simplify the illustration of the drawings.

It is to be understood that both the front portion 10 and the rear portion 20 of the weapon housing 11 can be interconnected within a suitable enclosure or encapsulation device or can be interconnected by not particularly illustrated spacer sleeves or spacer rods. Preferably, all four reinforced fiber band members 28, 29, 30 and 31 possess the same length and the same cross-sectional configuration and are composed of the same fiber material. Therefore, the smaller plug members 16, 19, 23 and 26 are arranged at a greater mutual spacing than the larger plug members 17, 18 and 24, 25.

Finally, although the invention has been described with reference to particular means, materials and embodiments, it is to be understood that the invention is not limited to the particulars disclosed and extends to all equivalents within the scope of the claims.

What is claimed is:

1. A weapon housing for a firing weapon, comprising:
- a front portion;
- a weapon barrel carried by said front portion;
- a rear portion arranged in spaced relationship from said front portion;
- a firing device for cartridges provided for said rear portion;
- means comprising cartridge chambers for laterally infeeding cartridges to the weapon housing of the firing weapon; and
- means including fiber band members for interconnecting said front portion and rear portion with one another and for maintaining the spaced relationship of said front portion and rear portion from one another.

2. The weapon housing as defined in claim 1, wherein:
- each of said fiber band members comprise carbon fibers imbued in a resin.

3. The weapon housing as defined in claim 2, wherein:
- said front portion comprises plug members;
- said rear portion comprises plug members;
- said fiber band members comprising endless fiber band members trained about said plug members of said front portion and said rear portion.

4. The weapon housing as defined in claim 3, wherein:
- said endless fiber band members comprise reinforced endless fiber band members; and
- means for securing said endless reinforced fiber band members to said plug members.

5. The weapon housing as defined in claim 4, wherein:
- said securing means comprise adhesive connection means for securing the endless fiber band members to said plug members.

6. The weapon housing as defined in claim 3, wherein:
- said endless fiber band members each have essentially the same length and the same cross-sectional configuration and are formed of fibers composed of the same fiber material.

7. A weapon housing comprising:
- a rear portion;
- a firing device carried by said rear portion;
- a front portion from which a projectile is ejected by means of said firing device; and a plurality of bands connected between said front portion and said rear portion for maintaining said front portion and said rear portion spaced apart and for permitting a projectile to be fed between said bands into a firing position.

8. The weapon housing of claim 7, wherein said bands are comprised of a means for absorbing gas pressure forces generated during firing of said projectile.

9. The weapon housing of claim 7, further comprising means for feeding projectiles to said firing position between a plurality of said bands.

10. The weapon housing of claim 7, wherein said bands are comprised of a fibrous material.

11. The weapon housing of claim 10, wherein said bands of fibrous material are imbued with resin.

* * * * *